US006518526B2

(12) United States Patent
Hamada et al.

(10) Patent No.: US 6,518,526 B2
(45) Date of Patent: Feb. 11, 2003

(54) HANDLE-OPERATING MECHANISM FOR A CIRCUIT BREAKER INCLUDING INTERMESHING HANDLE CLUTCH GEAR AND OPERATOR TOGGLE GEAR

(75) Inventors: Yoshinobu Hamada, Saitama (JP); Kentaro Toyama, Tokyo (JP); Tatsunori Takahashi, Saitama (JP); Naoshi Uchida, Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/963,464

(22) Filed: Sep. 27, 2001

(65) Prior Publication Data

US 2002/0038759 A1 Apr. 4, 2002

(30) Foreign Application Priority Data

Oct. 2, 2000 (JP) ..... 2000-302154

(51) Int. Cl.[7] ..... H01H 3/40; H01H 3/20

(52) U.S. Cl. ..... 200/330; 200/336; 200/501

(58) Field of Search ..... 200/329, 330, 200/331, 336, 338, 364–372, 501

(56) References Cited

U.S. PATENT DOCUMENTS 2,441,808 A * 5/1948 Fry ..... 200/11 G
3,592,982 A * 7/1971 Deltoer ..... 200/18 X
4,002,088 A * 1/1977 Alsch ..... 200/501 X
4,182,939 A * 1/1980 Feaster ..... 200/17 R
4,795,867 A * 1/1989 Ohi et al. ..... 200/501 X
5,111,009 A * 5/1992 Chan et al. ..... 200/330
5,219,070 A * 6/1993 Grunert et al. ..... 200/330

* cited by examiner

*Primary Examiner*—J. R. Scott
(74) *Attorney, Agent, or Firm*—Kanesaka & Takeuchi

(57) ABSTRACT

A handle-operating mechanism for a circuit breaker includes a rotary operating handle for opening and closing a main-circuit contact of a circuit breaker, a rotating gear operably connected to the operating handle and having a first engaging device, and a contact opening-and-closing mechanism having a toggle gear meshing with the rotating gear. A clutch gear is connected to the operating handle to be interposed between the operating handle and the rotating gear, and has a second engaging device. An idle stroke is formed such that when the circuit breaker is turned on, the operating handle runs idly after rotation of the operating handle has been started and before the second engaging device engages the first engaging device to drive the rotating gear for actuating the toggle gear.

5 Claims, 6 Drawing Sheets

HANDLE-OPERATING MECHANISM FOR A CIRCUIT BREAKER INCLUDING INTERMESHING HANDLE CLUTCH GEAR AND OPERATOR TOGGLE GEAR

BACKGROUND OF THE INVENTION AND RELATED ART STATEMENT

The present invention relates to a handle-operating mechanism for a circuit breaker that is provided with a rotary operating handle and is implemented in a molded-case circuit breaker or the like.

First, a conventional configuration of a circuit breaker provided with the rotary operating handle referred to above is shown in FIGS. 4 to 6(*b*). First, in FIG. 4, reference numeral 1 denotes a breaker case; reference numeral 2 denotes a breaking section for a main-circuit contact; reference numeral 3 denotes a contact opening-and-closing mechanism section; reference numeral 4 denotes an overcurrent tripping device; reference numeral 5 denotes a rotary operating handle installed on a top surface of the case 1; reference numeral 6 denotes a gear mechanism linking the operating handle 5 to the contact opening-and-closing mechanism section 3; and reference numeral 7 denotes an attachment, such as an auxiliary switch, an alarm switch, a voltage tripping device or an undervoltage tripping device, of the circuit breaker that is optionally installed in the case 1.

Here, the gear mechanism 6 is formed of a combination of a rotating gear (driving gear) 8 connected to a shaft of the operating handle 5, and a toggle gear 9 attached to the contact opening-and-closing mechanism section 3 so as to cross the rotating gear 8, as shown in FIG. 5. When the operating handle 5 is rotated from an OFF position to an ON position, a toggle link mechanism 3a in the contact opening-and-closing mechanism section 3 is pivoted via the gear mechanism 6 to turn on the main-circuit contact via an opening-and-closing lever (not shown). Conversely, when the operating handle 5 is rotated from the ON position to the OFF position, the toggle link mechanism 3*a* and an opening-and-closing spring 3*b* work together to open the main-circuit contact. When the overcurrent tripping device 4 is activated to perform a tripping operation in order to open the main-circuit contact, the operating handle 5 moves from the ON position to a TRIP position.

Further, FIGS. 6(*a*) and 6(*b*) show the conventional structure of the above-described gear mechanism 6. The rotating gear 8 has teeth 8*a* meshing with the toggle gear 9, and is coupled to a shaft 5*a* of the operating handle 5 in such a manner as to fit thereon. On the other hand, the toggle gear 9 is linked to the above-described toggle link mechanism by assembling a shaft thereof to the contact opening-and-closing mechanism section 3 so that the shaft crosses the rotating gear 8; the teeth of the toggle gear 9 mesh with the teeth 8*a* of the rotating gear 8. A return spring 10 urges the operating handle 5 in the direction of the OFF position.

The molded-case circuit breakers can be provided with various optional attachments. In particular, in an attachment, such as an undervoltage tripping device with an early-operation contact that detects an abnormal voltage to trip the circuit breaker, when the handle is operated to turn on the circuit breaker, the contact within the attachment must be closed to transmit a signal before the contact opening-and-closing mechanism section performs a turn-on operation.

Thus, in a conventional circuit breaker provided with a tumbler-type operating handle, an auxiliary handle that is withdrawn from the undervoltage tripping device with the early-operation contact is linked to the operating handle of the breaker main body, and the built-in contact of the undervoltage tripping device is turned on while the operating handle is being switched from the OFF position to the ON position.

On the other hand, the following is required to allow the above-described circuit breaker provided with the rotary operating handle to accommodate the above-described undervoltage tripping device (attachment) with the early-operation contact. Namely, an idle stroke must be set such that when the circuit breaker is turned on, the operating handle 5 shown in FIG. 6(*a*) runs with idle or play after the handle 5 has started its rotation from the OFF position and before the toggle gear 9 of the contact opening-and-closing mechanism section 3 is driven, so that, during this stroke, the built-in contact of the attachment can be closed to transmit the signal. Moreover, the handle operation mechanism must provide a function for fixing the operating handle in the ON position after the main-circuit contact has been turned on.

The present invention has been made in view of the above points, and it is an object of the invention to provide a handle-operating mechanism for a circuit breaker that is operative when the circuit breaker is turned on, to allow a signal to be transmitted to an attachment, such as an undervoltage tripping device with an early-operation contact, before a contact opening-and-closing mechanism section of the circuit breaker operates.

Further objects and advantages of the invention will be apparent from the following description of the invention.

SUMMARY OF THE INVENTION

To attain the above object, the present invention provides a handle-operating mechanism for a circuit breaker comprising a rotary operating handle manually operated to open and close a main-circuit contact of a circuit breaker. The operating handle and a contact opening-and-closing mechanism section are linked together via a rotating gear connected to the operating handle and via a toggle gear provided in the contact opening-and-closing mechanism and meshing with the rotating gear. In the handle-operating mechanism, a clutch gear is interposed between the operating handle and the rotating gear, and an idle stroke is set in which, when the circuit breaker is turned on, the operating handle runs idly after the operating handle has started rotation and before the rotating gear drives the toggle gear of the contact opening-and-closing mechanism section.

Further, the above-mentioned clutch gear is set such that a tooth thereof meshes with the toggle gear while overlapping a tooth of the rotating gear in a manner such that the clutch gear is coupled to the rotating gear. The clutch gear is combined with a return spring and connected to the operating handle.

With the above configuration, when the rotary operating handle is manually operated to turn on the circuit breaker, it runs idly during the idle stroke that starts when it starts rotation and ends when the clutch gear is linked to the rotating gear to drive the toggle gear of the contact opening-and-closing mechanism section. Consequently, during this stroke, the signal can be transmitted to an attachment, such as an undervoltage tripping device with an early-operation contact, for detecting an abnormal voltage at the main circuit, before the opening-and-closing mechanism section of the main-circuit contact operates.

Furthermore, after the main-circuit contact has been turned on, the toggle gear linked to the toggle link of the contact opening-and-closing mechanism section is held and bound in this position with the teeth of the rotating gear and the clutch gear meshing therewith, so that the operating handle is fixed in the ON position without any play. On the other hand, when the main-circuit contact is opened, the operating handle rotates synchronously with the rotating gear, in contrast to the turn-on operation. Once the tooth of the clutch gear is disengaged from the toggle gear, the rotating gear remains in the same position, and the spring force of the return spring is exerted to cause the operating handle to run idly together with the clutch gear to return to the OFF position.

DETAILED DESCRIPTION OF PREFERRED EMBODIMENT

Figure 1:
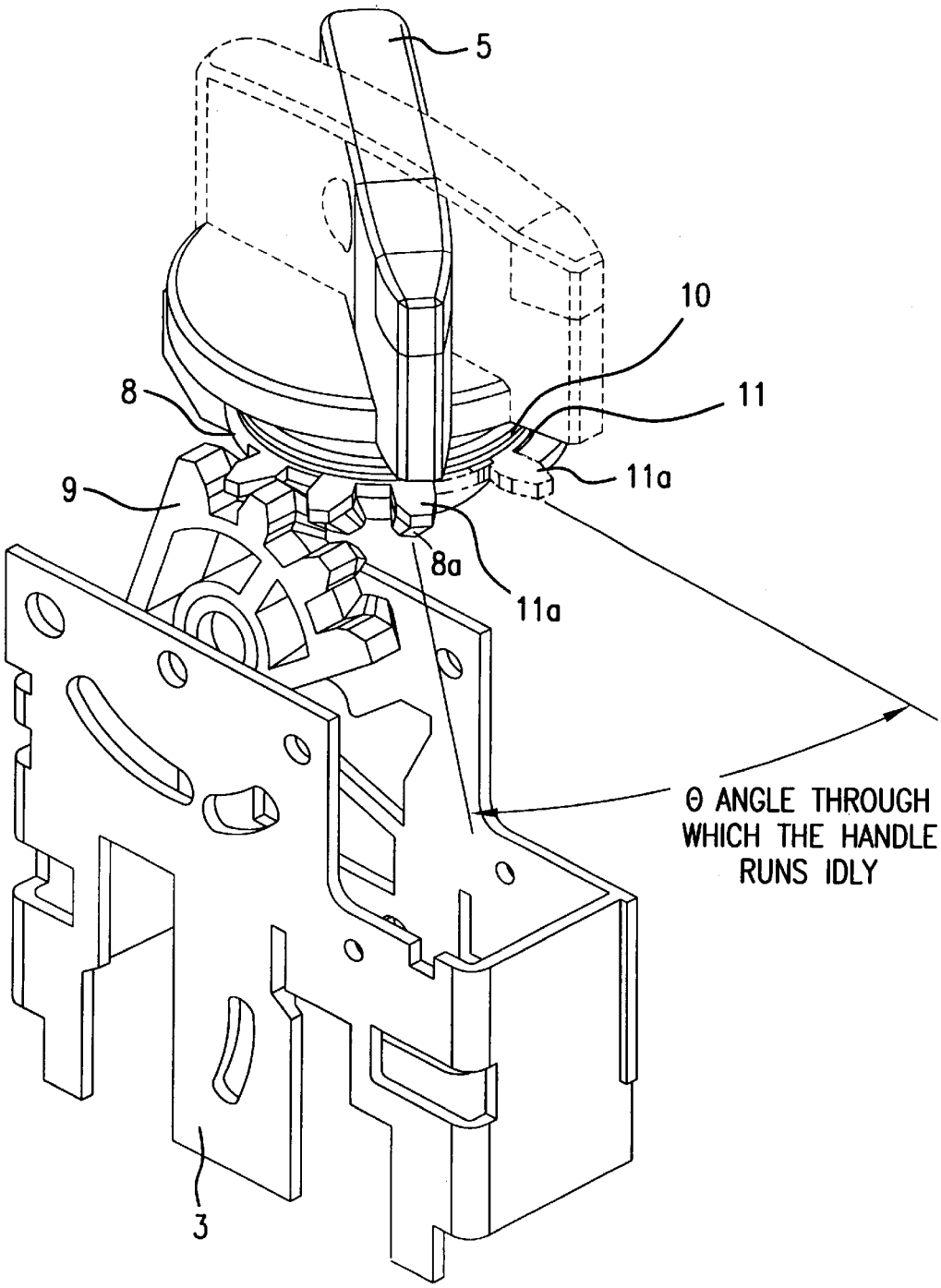
FIG. 1 is an explanatory perspective view of a handle-operating mechanism for an idle running operation of an operating handle according to an embodiment of the present invention.
Figure 6A:
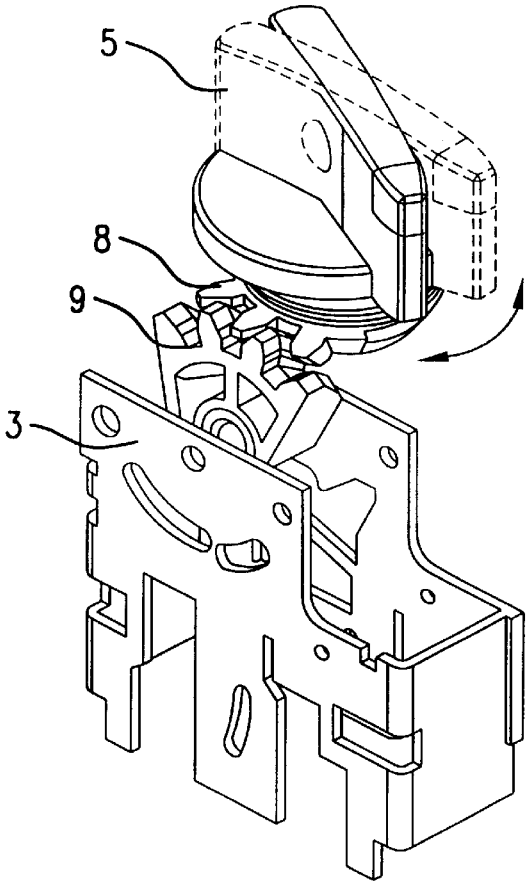
FIG.6A PRIOR ART
FIG. 6(*a*) is an explanatory perspective view showing a conventional configuration of a handle-operating mechanism employed in the circuit breaker shown in FIG. 5, and FIG. 6(*b*) is an exploded perspective view of the handle-operating mechanism.
Figure 6B:
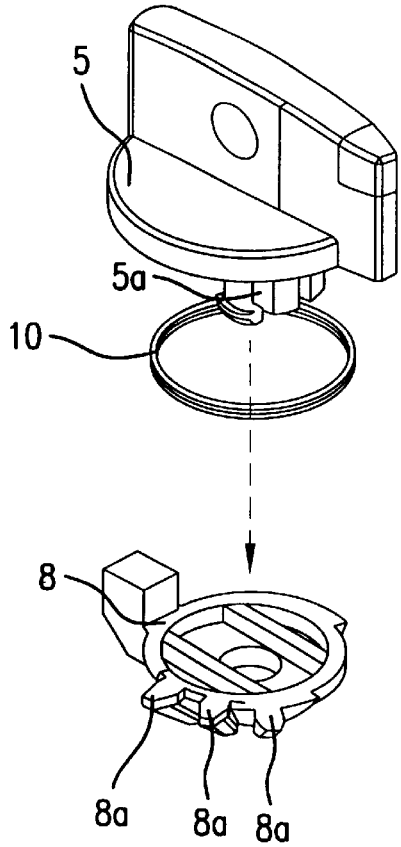
FIG.6B PRIOR ART

An embodiment of the present invention will be described below with reference to FIGS. 1 to 3. In the figures of the embodiment, the same members as those in FIGS. 6(*a*) and 6(*b*) have the same reference numerals, and detailed descriptions thereof are thus omitted.

Figure 3:
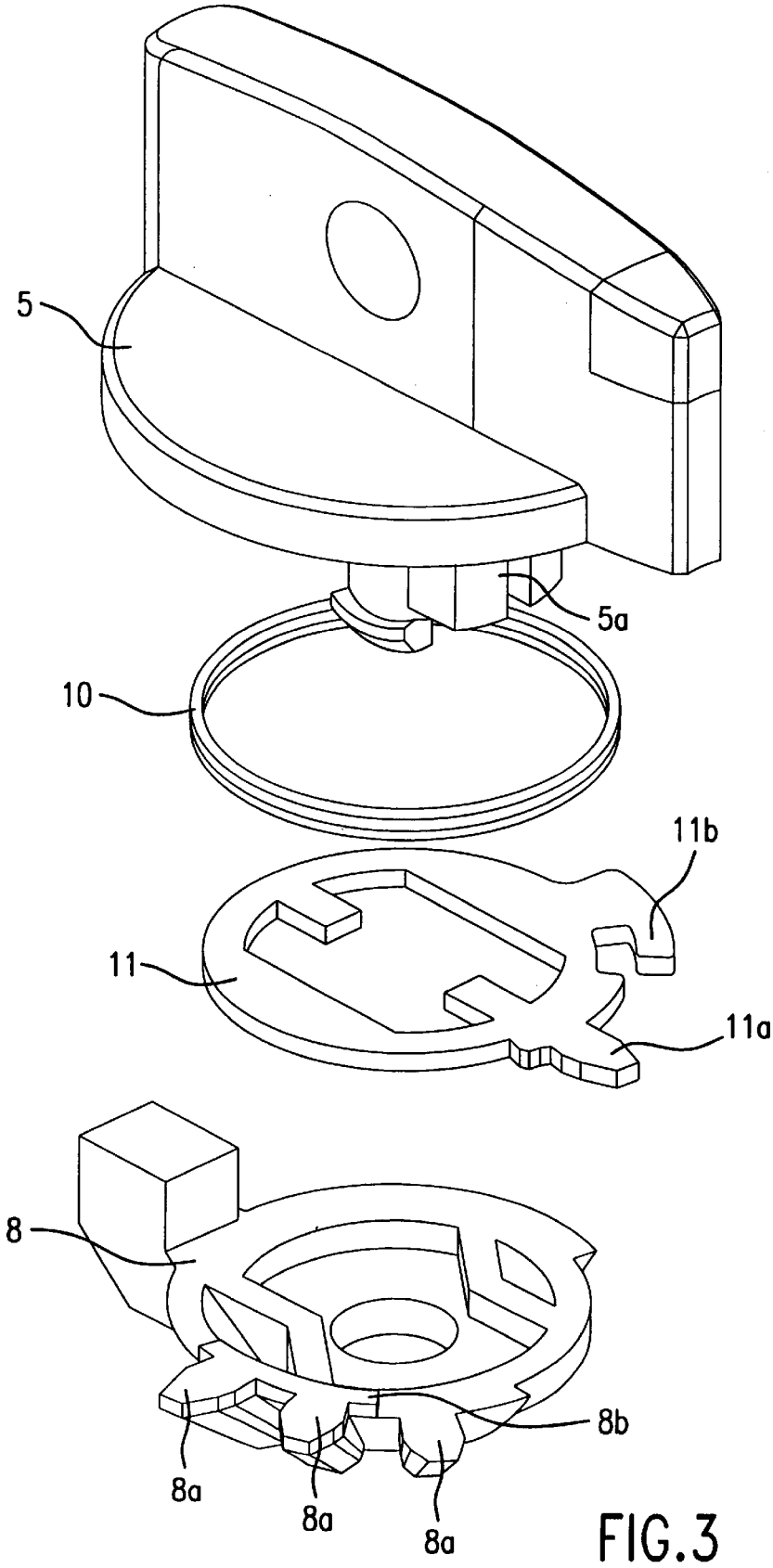
FIG. 3 is an exploded perspective view of the handle-operating mechanism shown in FIG. 1.
Figure 4:
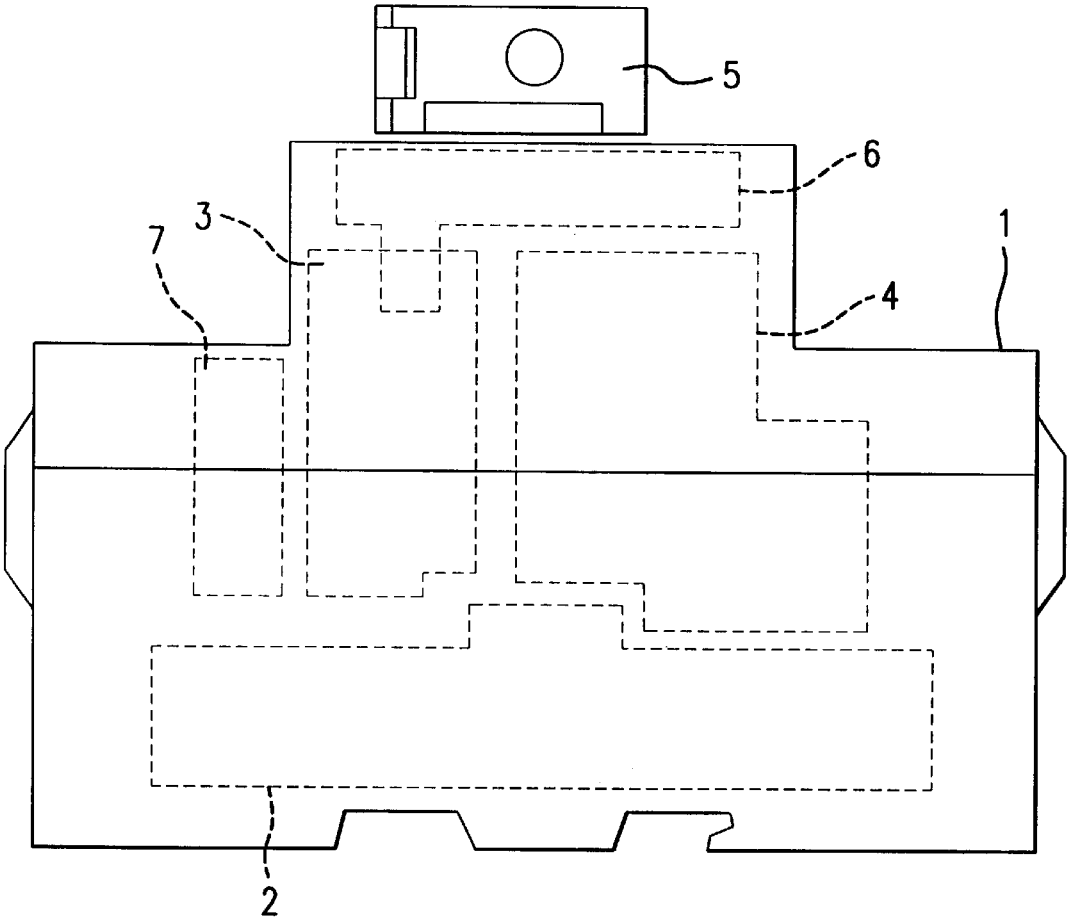
FIG.4 PRIOR ART
FIG. 4 is a schematic diagram of an entire circuit breaker provided with a rotary operating handle in a conventional structure.
Figure 5:
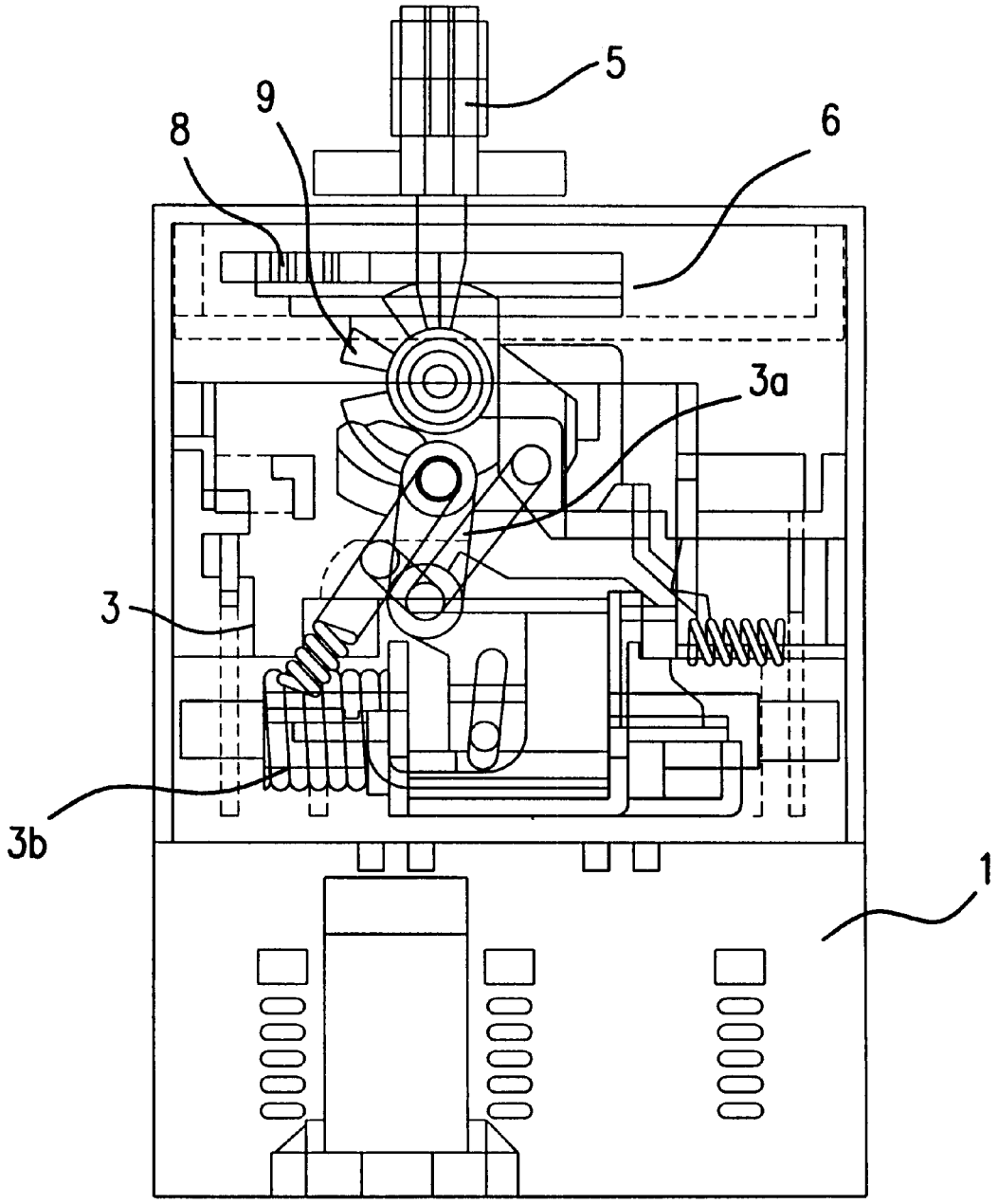
FIG.5 PRIOR ART
FIG. 5 is a sectional view of the configuration of an integral part of FIG. 4.

In the illustrated embodiment, a clutch gear 11 is additionally interposed between the rotary operating handle 5 and the rotating gear 8, as shown in FIG. 3. In this case, the rotating gear 8 is not directly coupled to the operating handle 5, but is loosely fitted and supported in such a manner that a circumferential play gap is formed between the rotating gear 8 and the handle shaft 5*a*. On the periphery of the rotating gear 8 and next to the train of teeth (three teeth) 8*a*, there are formed a stage or step portion 8*b* engaging a projection of the clutch gear 11, which will be described later, and a circumferential recess in which the projection of the clutch gear 11 moves idly.

On the other hand, the clutch gear 11 is fitted on and coupled to the handle shaft 5*a* using a key groove so as to rotate synchronously with the operating handle 5. On the periphery of the clutch plate, there are formed one tooth 11*a* and an L-shaped engaging projection 11*b* arranged behind the tooth 11*a* and projecting in a lateral direction. When the operating-handle mechanism is assembled, the rotating gear 8 overlaps a bottom surface of the clutch gear 11, which is combined with the operating handle 5 and the return spring 10. In this position, the tooth 11*a* of the clutch gear 11 is loosely fitted on the recess on the periphery of the rotating gear 8, and the teeth 8*a* of the rotating gear 8 mesh with the train of teeth of the toggle gear 9, which has been assembled to the contact opening-and-closing mechanism section 3.

Next, an operation of the handle-operating mechanism configured as described above will be described. First, FIG. 2(*a*) shows the circuit breaker in the OFF position. As shown in the figure, the operating handle 5 recedes to the OFF position due to the urging force of the return spring 10, and the clutch gear 11 and the rotating gear 8 are released from each other and are not linked together. Further, the toggle gear 9 linked to the contact opening-and-closing mechanism section 3 is bound and held so as to incline clockwise from a neutral position. In this position, the toggle gear 9 meshes with the front tooth 8*a* of the rotating gear 8.

Figure 2A:
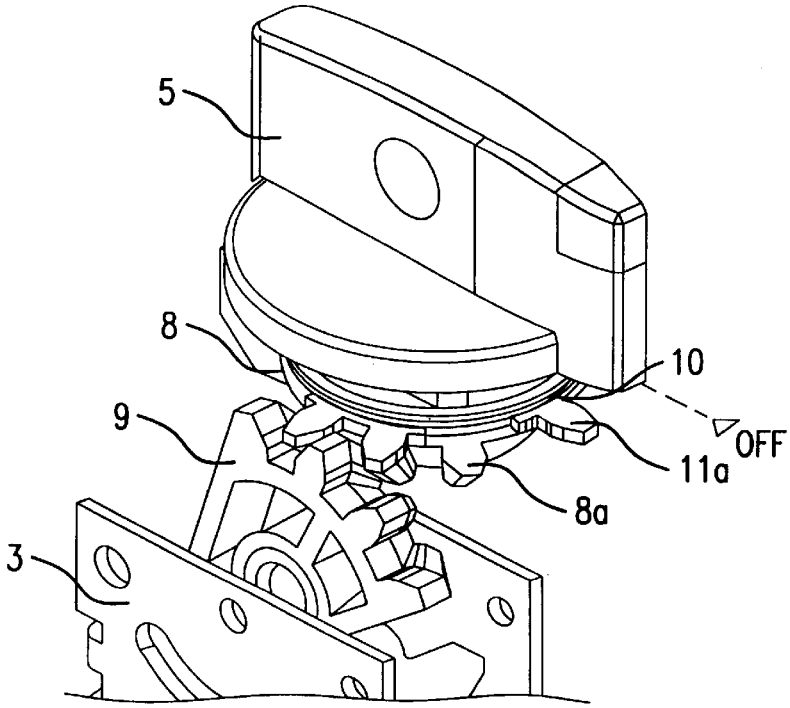
FIG. 2(*a*) is an explanatory perspective view showing the operating handle shown in FIG. 1 in an OFF position, and FIG. 2(*b*) is an explanatory perspective view of the operating handle in an ON position.
Figure 2B:
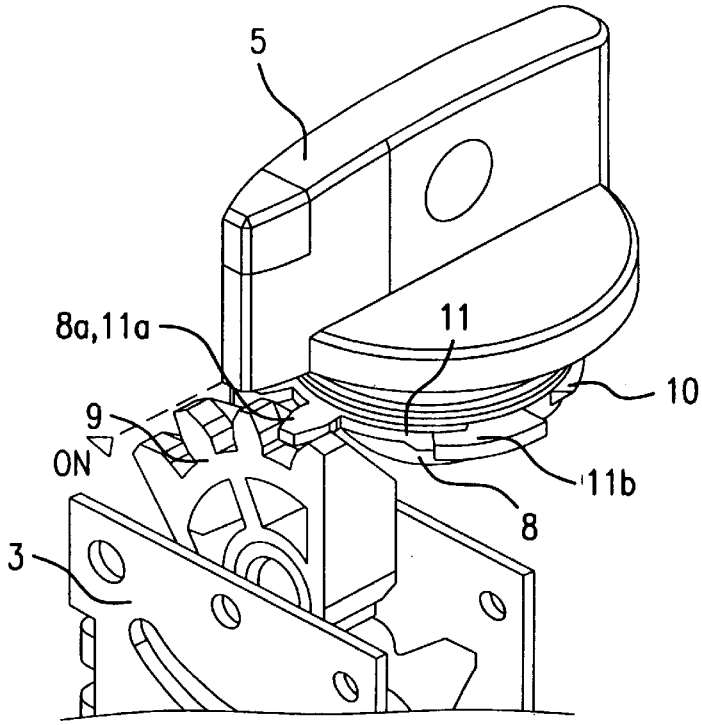

Further, in FIG. 2(*b*), the circuit breaker is turned on by rotating the operating handle 5 to the ON position. As shown in the figure, the tooth 11*a* of the clutch gear 11 abuts against and pushes the engaging stage portion of the rotating gear 8, so that the clutch gear 11 and the rotating gear 8 are linked together. The tooth 11*a* of the clutch gear 11 and the rearmost tooth 8*a* of the rotating gear 8 mesh with the toggle gear 9 in such a manner that the tooth 11*a* and the rearmost tooth 8*a* overlap each other in the vertical direction. In this turn-on state, the operation of the contact opening-and-closing mechanism section 3 causes the toggle gear 9 to be bound and held so as to incline counterclockwise from the neutral position. Accordingly, the tooth 8*a* of the rotating gear 8 and the tooth 11*a* of the clutch gear 11 remain meshing with the toggle gear 9, and the operating handle 5, connected to the toggle gear 11, is bound and held in the ON position with its idle running function being disabled.

On the other hand, when the operating handle 5 is manually rotated clockwise from the OFF position, shown in FIG. 2(*a*), to the ON position, in order to turn on the circuit breaker, the operating handle 5 runs idly in synchronism with the clutch gear 11, with the rotating gear 8 remaining to be stopped, as the clutch gear 11 and rotating gear 8 are initially not linked together. This idle running continues until the tooth 11*a* of the clutch gear 11 comes to abut against the engaging stage portion 8*b* of the rotating gear 8. Once the tooth 11*a* comes to abut against the engaging stage portion 8*b*, the clutch gear 11 and the rotating gear 8 are linked together so that the rotating gear 8 subsequently rotates together with the operating handle 5 and the clutch gear 11 to transmit power to the toggle gear 9.

In this connection, when the rotating gear 8 and the clutch gear 11 are linked together, the tooth 11*a* of the clutch gear 11 and the rearmost tooth 8*a* of the rotating gear 8 overlap each other in the vertical direction. An idle stroke of the operating handle 5 is set and represented by angle e in which the handle runs idly between the OFF position of the operating handle 5 indicated by the dotted line and the handle position (where the clutch gear 11 and the rotating gear 8 are linked together) indicated by the solid line, as shown in FIG. 1.

Accordingly, even if the circuit breaker includes, as an attachment, an undervoltage tripping device with an early-operation contact, when the circuit breaker is turned on, the above-described idle stroke of the operating handle 5 can be used to close the built-in contact of the attachment so as to transmit a signal before the main-circuit contact is closed.

Moreover, as described above, while the circuit breaker is on, the operating handle 5 is bound and held in the ON position via the clutch gear 11 so as not to be freely movable from this position, thereby preventing a user from failing to notice that the breaker has been turned on.

Further, if the handle is operated to open the circuit breaker and the operating handle 5 is rotated counterclockwise from the ON position to the OFF position, the contact opening-and-closing mechanism section 3 performs a reverse operation in a directly coupled state in which the tooth 8*a* of the rotating gear 8 and the tooth 11*a* of the clutch gear 11 mesh with the toggle gear 9. Then, when the tooth 11*a* of the clutch gear 11 is disengaged from the toggle gear 9, the rotating gear 8 remains in the same position, while the operating handle 5 and the clutch gear 11 return to the OFF position due to the urging force of the return spring 10.

As described above, the present invention provides the handle-operating mechanism for the circuit breaker comprising the rotary operating handle manually operated to open and close the main-circuit contact of the circuit breaker. The operating handle and the contact opening-and-closing mechanism section are linked together via the rotating gear connected to the operating handle and via the toggle gear in the contact opening-and-closing mechanism and meshing with the rotating gear. The clutch gear is interposed between the operating handle and the rotating gear, and the idle stroke is set such that when the circuit breaker is turned on, the operating handle runs idly after the handle has started its rotation and before the rotating gear drives the toggle gear of the contact opening-and-closing mechanism section. Further, the clutch gear comprises the tooth that meshes with the toggle gear while overlapping the tooth of the rotating gear in such a manner that the clutch gear is coupled to the rotating gear, and the clutch gear is combined with the return spring and connected to the operating handle.

Consequently, the present invention provides the following effects:

(1) When the rotary operating handle is operated to turn on the circuit breaker, it runs idly during the idle stroke that starts when the handle has started its rotation, and ends when the clutch gear is linked to the rotating gear to drive the toggle gear of the contact opening-and-closing mechanism section. Consequently, during this stroke, a built-in contact of an undervoltage tripping device with an early-operation contact for detecting an abnormal voltage at the main circuit can be closed so as to transmit a signal, before the opening-and-closing mechanism section of the main-circuit contact operates.

(2) After the main-circuit contact has been turned on, the operating handle is fixed in the ON position and is prevented from running idly therefrom, thereby preventing a user from failing to notice that the breaker has been turned on. Furthermore, if the handle is operated to open the circuit breaker, the contact opening-and-closing mechanism section can be driven and operated with the operating handle coupled directly to the rotating gear so as not to run idly. Therefore, the circuit breaker can accommodate attachments, such as an undervoltage tripping device with the early-operation contact, and can be appropriately opened and closed by operating the handle.

While the invention has been explained with reference to the specific embodiment of the invention, the explanation is illustrative and the invention is limited only by the appended claims.

What is claimed is:

1. A handle-operating mechanism for a circuit breaker, comprising:

a rotary operating handle operated to open and close a main-circuit contact of the circuit breaker, a rotating gear operably connected to the operating handle and having first engaging means, a contact opening-and-closing mechanism having a toggle gear meshing with the rotating gear, said contact opening-and-closing mechanism being linked to the operating handle through the rotating gear and the toggle gear, and a clutch gear connected to the operating handle and interposed between the operating handle and the rotating gear and having second engaging means to form an idle stroke such that when the circuit breaker is turned on, the operating handle runs idly after rotation of the operating handle has been started and before the second engaging means engages the first engaging means to drive the rotating gear for actuating the toggle gear of the contact opening-and-closing mechanism.

2. A handle-operating mechanism according to claim 1, wherein said clutch gear and the rotating gear have teeth to mesh with the toggle gear, and the clutch gear is coupled to the rotating gear in a condition that the teeth of the clutch gear and rotating gear overlap.

3. A handle-operating mechanism according to claim 2, further comprising a return spring coupled with the clutch gear.

4. A handle-operating mechanism according to claim 3, wherein said rotating gear has a step portion as the first engaging means to be able to engage the tooth of the clutch gear as the second engaging means.

5. A handle-operating mechanism according to claim 4, wherein said handle is operated manually.

* * * * *